US010590800B2

(12) United States Patent
Zhang et al.

(10) Patent No.: US 10,590,800 B2
(45) Date of Patent: Mar. 17, 2020

(54) METHOD FOR SELECTIVE ALUMINIDE DIFFUSION COATING REMOVAL

(71) Applicants: GENERAL ELECTRIC COMPANY, Schenectady, NY (US); Liming Zhang, Greer, SC (US); Jere A. Johnson, Greenville, SC (US); Ying Zhou, Qinhuangdao (CN)

(72) Inventors: Liming Zhang, Greer, SC (US); Jere A. Johnson, Greenville, SC (US); Ying Zhou, Qinhuangdao (CN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 462 days.

(21) Appl. No.: 15/310,805

(22) PCT Filed: Sep. 25, 2014

(86) PCT No.: PCT/CN2014/087417
§ 371 (c)(1),
(2) Date: Nov. 14, 2016

(87) PCT Pub. No.: WO2016/045043
PCT Pub. Date: Mar. 31, 2016

(65) Prior Publication Data

US 2017/0081977 A1 Mar. 23, 2017

(51) Int. Cl.
*C23C 10/08* (2006.01)
*F01D 25/14* (2006.01)
(Continued)

(52) U.S. Cl.
CPC ..... *F01D 25/145* (2013.01); *B24C 1/086* (2013.01); *C23C 10/28* (2013.01); *C23C 10/60* (2013.01);
(Continued)

(58) Field of Classification Search
None
See application file for complete search history.

(56) References Cited

U.S. PATENT DOCUMENTS 5,222,282 A 6/1993 Sukonnik et al.
5,366,765 A * 11/1994 Milaniak ..... C23C 10/20 427/229
(Continued)

FOREIGN PATENT DOCUMENTS

CN 101613819 A 12/2009
CN 103382544 A 11/2013
(Continued)

OTHER PUBLICATIONS

International Search Report and Written Opinion issued in connection with corresponding PCT Application No. PCT/CN2014/087417 dated Jun. 17, 2015.
(Continued)

*Primary Examiner* — Adam Krupicka
(74) *Attorney, Agent, or Firm* — McNees Wallace & Nurick LLC

(57) ABSTRACT

A method for selective aluminide diffusion coating removal. The method includes diffusing aluminum into a substrate surface of a component to form a diffusion coating. The diffusion coating includes an aluminum-infused additive layer and an interdiffusion zone. The diffusion coating is solution heat treated at a temperature and for a time sufficient to dissolve at least a portion of the interdiffusion zone. Thereafter the aluminum-infused additive layer is selectively removed. An aluminide diffusion coated turbine component is also disclosed.

20 Claims, 4 Drawing Sheets

(51) Int. Cl.

| | |
|---|---|
| ***C23C 10/28*** | (2006.01) |
| ***C23C 10/60*** | (2006.01) |
| ***C23F 4/04*** | (2006.01) |
| ***C23F 1/02*** | (2006.01) |
| ***B24C 1/08*** | (2006.01) |
| ***C23F 1/20*** | (2006.01) |
| ***C23F 4/02*** | (2006.01) |
| ***F01D 25/00*** | (2006.01) |

(52) U.S. Cl.
CPC ..... *C23F 1/02* (2013.01); *C23F 1/20* (2013.01); *C23F 4/02* (2013.01); *C23F 4/04* (2013.01); *F01D 25/005* (2013.01); *F05D 2230/90* (2013.01)

(56) References Cited

U.S. PATENT DOCUMENTS

| | | | |
|---|---|---|---|
| 5,667,663 | A | 9/1997 | Rickerby et al. |
| 6,036,995 | A | 3/2000 | Kircher et al. |
| 6,174,448 | B1 | 1/2001 | Das et al. |
| 6,334,907 | B1 * | 1/2002 | Das ..... C23C 10/08 148/280 |
| 6,482,469 | B1 | 11/2002 | Spitsberg et al. |
| 6,719,853 | B2 | 4/2004 | Buergel et al. |
| 7,093,335 | B2 | 8/2006 | Conner et al. |
| 8,021,491 | B2 | 9/2011 | Kool et al. |
| 8,252,376 | B2 | 8/2012 | Buergel et al. |
| 8,383,214 | B2 | 2/2013 | Schaepkens et al. |
| 8,449,262 | B2 | 5/2013 | Strangman |
| 8,475,598 | B2 | 7/2013 | Cetel et al. |
| 2010/0062180 | A1 | 3/2010 | Tuppen et al. |

FOREIGN PATENT DOCUMENTS

| | | |
|---|---|---|
| EP | 0 713 957 A1 | 5/1996 |
| EP | 0 814 179 A1 | 12/1997 |
| GB | 2 401 115 A | 11/2004 |

OTHER PUBLICATIONS

Extended European Search Report and Opinion issued in connection with corresponding EP Application No. 14902582.7 dated Apr. 25, 2018.

* cited by examiner

METHOD FOR SELECTIVE ALUMINIDE DIFFUSION COATING REMOVAL

FIELD OF THE INVENTION

The present invention is directed to a process of forming or refurbishing an aluminum diffusion coating. More particularly, the present invention is directed to a process for forming or refurbishing an aluminide coating by (1) selective removal of the diffusion coating and (2) minimizing the base metal removal.

BACKGROUND OF THE INVENTION

Higher operating temperatures for gas turbines are continuously sought in order to increase their efficiency. However, as operating temperatures increase, the high temperature durability of the components of the turbine must correspondingly increase. Significant advances in high-temperature capabilities have been achieved through the formulation of nickel and cobalt-based superalloys, though without a protective coating components formed from superalloys typically cannot withstand long service exposures if located in certain sections of a gas turbine, such as the turbine or combustor. One such type of coating is referred to as an environmental coating, i.e., a coating that is resistant to oxidation and hot corrosion. Environmental coatings that have found wide use include diffusion aluminide coatings formed by diffusion processes, such as a pack cementation, vapor phase processes and slurry processes.

Though significant advances have been made with environmental coating materials and processes for forming such coatings, there is the inevitable requirement to repair these coatings under certain circumstances. For example, removal may be necessitated by erosion or thermal degradation of the diffusion coating, refurbishment of the component on which the coating is formed, or an in-process repair of the diffusion coating or a thermal barrier coating (if present) adhered to the component by the diffusion coating. Known repair processes completely remove the diffusion aluminide coating by treatment with an acidic solution capable of interacting with and removing both the additive and diffusion coatings.

Removal of the entire aluminide coating, which includes the diffusion zone, results in the removal of a portion of the substrate surface. For gas turbine engine blade and vane airfoils, removing the diffusion zone can cause alloy depletion of the substrate surface and, for air-cooled components, excessively thinned walls and drastically altered airflow characteristics to the extent that the component must be scrapped. Therefore, rejuvenation processes have been developed for situations in which a diffusion aluminide coating must be refurbished in its entirety, but removal of the coating is not desired or allowed because of the effect on component life. Known rejuvenation processes, as shown in FIG. 1, generally include a deposition of an aluminum-infused additive layer 107 on the metallic substrate 101 along a substrate surface 103. When the component is in need of rejuvenation, such as after operation, the diffusion coating 105 including the aluminum-infused additive layer 107 and an interdiffusion zone 109 generally below the substrate surface 103 are fully removed, leaving a post-treatment surface 111 below the original exposed surface 103, resulting in lost wall thickness 113. The reduced wall thickness 113 results in a degradation of the component and reduced life cycles. This known aluminide refurbishment process undesirably removes about 0.7 mil thick wall of base materials or more while stripping the diffusion coating including interdiffusion zone 109.

From the above, it can be appreciated that improved methods for refurbishing a diffusion aluminide coating are desired. A method that can refurbish a coated article by forming diffusion aluminide coatings on metallic substrates that does not suffer from one or more of the above drawbacks would be desirable in the art.

SUMMARY OF THE INVENTION

In one embodiment, a method for selective aluminide diffusion coating removal. The method includes diffusing aluminum into a substrate surface of a component to form a diffusion coating. The diffusion coating includes an aluminum-infused additive layer and an interdiffusion zone. The diffusion coating is solution heat treated at a temperature and for a time sufficient to dissolve at least a portion of the interdiffusion zone. Thereafter the aluminum-infused additive layer is selectively removed.

In another embodiment, a method for aluminide diffusion coating removal from a substrate of a gas turbine component. The method includes removing the component from a gas turbine after operation of the gas turbine. The component includes a diffusion coating having an aluminum-infused additive layer and an interdiffusion zone. The diffusion coating is solution heat treated at a temperature and for a time sufficient to dissolve at least a portion of the interdiffusion zone. Thereafter the aluminum-infused additive layer is selectively removed.

In another embodiment, an aluminide diffusion coated turbine component. The aluminide diffusion coated turbine component includes a substrate including a nickel-based or cobalt-based superalloy. The coated turbine component having an aluminide diffusion coating on a surface of the substrate. The aluminide diffusion coating has a dissolved interdiffusion zone. The dissolved interdiffusion zone is resistant to removal.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided is a process for forming or refurbishing a diffusion aluminide coating with selective removal of the diffusion coating. Embodiments of the present disclosure, in comparison to similar concepts failing to include one or more of the features disclosed herein, minimize base materials loss and permit retention of wall thickness in components, permit easy processing with available methods, such as light grit blasting or short term acid dips, reduce the risk of chemical corrosive attacks to metallic substrates (e.g., intergranular attack (IGA) or pitting or alloy depletion), reduce the risk of component dimensional distortion, reduce scrap rate and facilitate subsequent processing, such as welding, brazing and re-coating repair.

Figure 1:
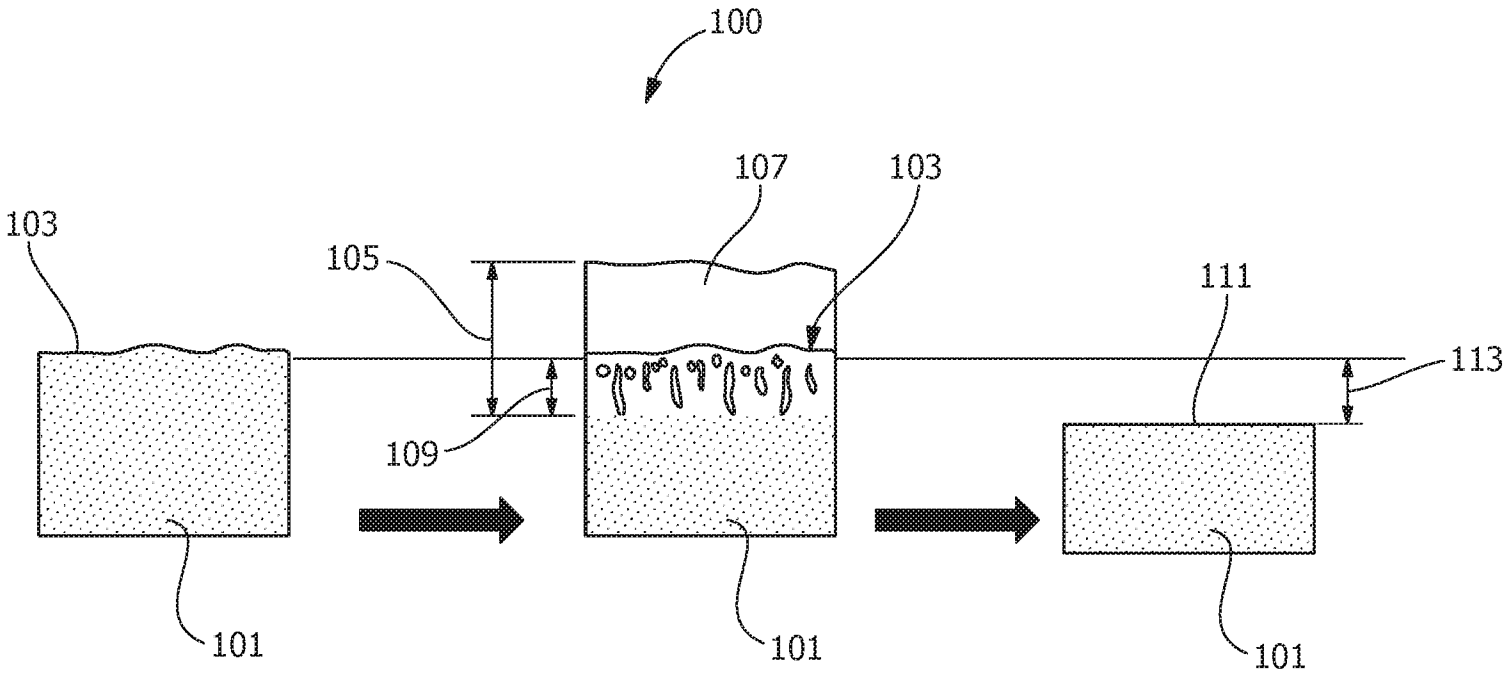
FIG. 1 schematically shows a known process for forming a diffusion aluminide coating and stripping serviced coating for repair.
Figure 2:
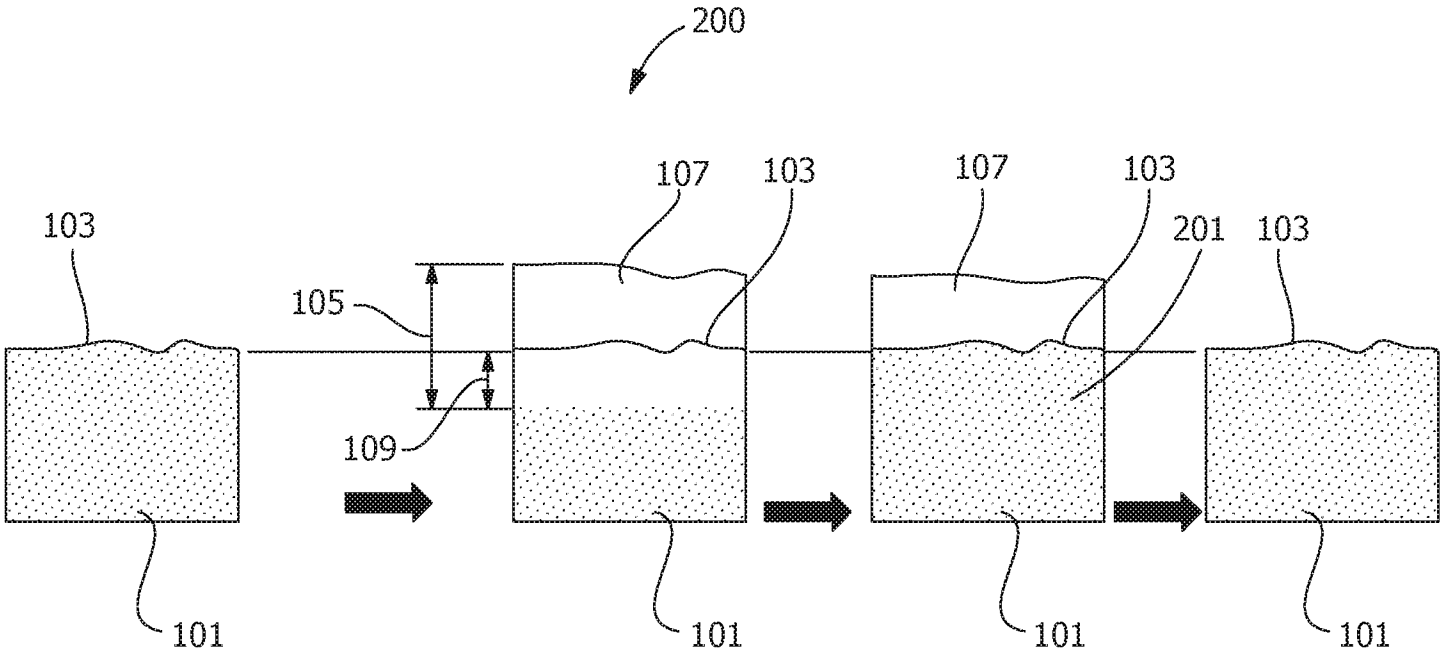
FIG. 2 schematically shows a process for forming a diffusion aluminide coating, and stripping serviced coating for repair, according to the present disclosure.
Figure 3:
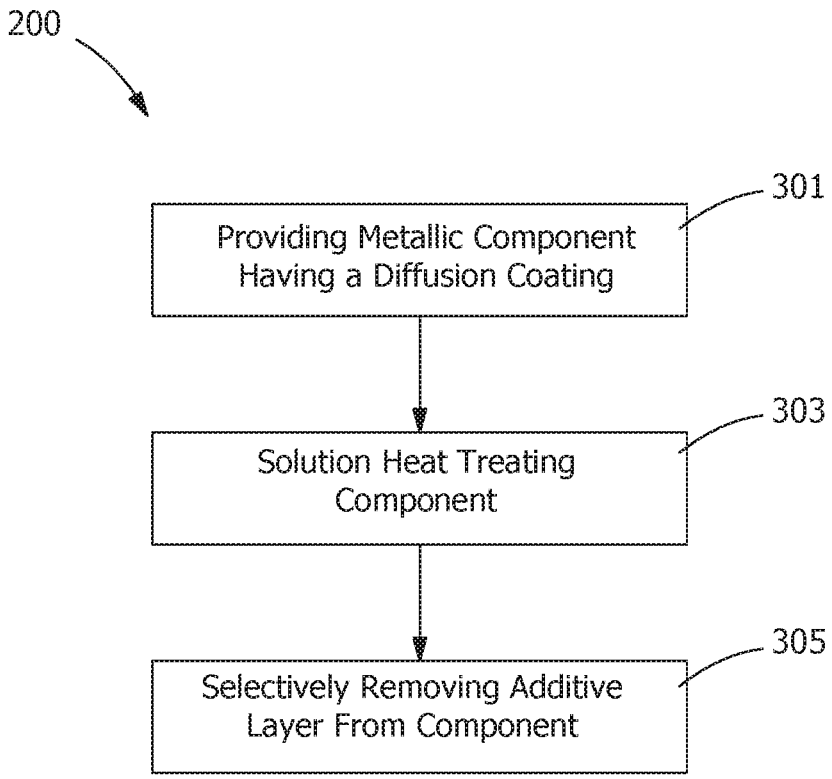
FIG. 3 shows a process flow diagram for a process for stripping a diffusion aluminide coating for serviced gas turbine components, according to the present disclosure.

FIGS. 2-3 illustrate a method 200, according to the present disclosure. FIG. 2 shows a deposition of an aluminum-infused additive layer 107 on the metallic substrate 101 along a substrate surface 103. As used herein, "metallic" refers to substrates which are primarily formed of metal or metal alloys, but which may also include some nonmetallic components. Non-limiting examples of metallic materials are those which comprise at least one element selected from the group consisting of iron, cobalt, nickel, aluminum, chromium, titanium, and mixtures which include any of the foregoing (e.g., stainless steel). A particularly suitable metallic material for substrate 101 includes a superalloy material. Such materials are known for high-temperature performance, in terms of tensile strength, creep resistance, oxidation resistance, and corrosion resistance. The superalloy is typically nickel-, cobalt-, or iron-based, although nickel- and cobalt-based alloys are favored for high-performance applications. The base element, typically nickel or cobalt, is the single greatest element in the superalloy by weight. Illustrative nickel-based superalloys include at least about 40% Ni by weight, and at least one component from the group consisting of cobalt, chromium, aluminum, tungsten, molybdenum, titanium, and iron. Illustrative cobalt-based superalloys include at least about 30% Co by weight, and at least one component from the group consisting of nickel, chromium, tungsten, molybdenum, tantalum, manganese, carbon, and iron. The actual configuration of a substrate 101 may vary widely.

As shown in FIG. 3, a component is provided having a diffusion coating 105, the diffusion coating including the aluminum-infused additive layer 107. In one embodiment the component is a component that has been in service and requires refurbishment. For example, suitable components include combustor liners, combustor domes, shrouds, turbine blades (or buckets), nozzles or vanes, are typical substrates that may be treated, according to embodiments of the disclosure. In one embodiment, the aluminum-infused additive layer is an intermediate coating overlying the substrate 101 and is disposed between the substrate 101 and a thermal barrier coating (TBC). The TBC is a separate and distinct coating from the metallic bond coat. In one embodiment, the component is stripped of any overlying thermal barrier coatings (TBC). The TBC may be removed by any suitable process. For example, the TBC may be removed by grit blasting.

In one embodiment, the component including the aluminum-infused additive layer 107 is subjected to conditions, such as turbine operation, that result in diffusion of aluminum into the substrate surface 103. The component including the diffusion coating 105, as shown in FIGS. 2 and 3, includes the aluminum-infused additive layer 107 and an interdiffusion zone 109. The diffusion coating 105 includes an aluminum-infused additive layer 107 and an interdiffusion zone 109. The term metallic "bond coat" or "diffusion coating" includes a variety of metallic materials applied to a substrate material to improve adherence of top coat materials while imparting high temperature oxidation resistance to the substrate materials comprising metallic alloys. Non-limiting examples of such metallic bond coat materials include coatings of diffusion aluminides and overlay aluminides, such as nickel aluminides (NiAl), platinum aluminides (PtAl), NiPtAl, as well as MCrAlX, where M is an element selected from the group consisting of nickel (Ni), cobalt (Co), iron (Fe) and combinations thereof and X is one or more elements selected from the group of solid solution strengtheners; gamma prime formers selected from Y, Ti, Ta, Re, Mo and W; grain boundary strengtheners selected from B, C, Hf and Zr and combinations thereof. The terms "aluminide bond coat" or "aluminide diffusion coating" are used generally to refer to any of these metallic coatings commonly applied to superalloy and high temperature turbine components. The diffusion process may include any known process for providing aluminide diffusion coatings. The chemistry of the additive layer can be modified by the presence in the aluminum-containing composition of additional elements, such as platinum, chromium, silicon, rhodium, hafnium, yttrium and zirconium. Excess aluminum-infused additive coating may be deposited. For example, the aluminum-infused additive layer 107 has a thickness in excess of about 100 micrometers. The interdiffusion zone 109 of the diffusion coating 105 extends below the original substrate surface 103 into the substrate 101. The interdiffusion zone 109 contains various intermetallic and metastable phases that form during the coating reaction as a result of diffusional gradients and changes in elemental solubility in the local region of the substrate 101. The intermetallics within the diffusion zone are the products of all alloying elements of the substrate 101 and diffusion coating 105.

After the component is provided having the diffusion coating 105, the component is subjected to a solution heat treatment (step 303). Solution heat treatment includes a heat treatment at a temperature and for a time sufficient to dissolve at least a portion of the interdiffusion zone 109 into the substrate 101 to form a dissolved interdiffusion zone 201. Suitable temperatures for the solution heat treatment include, but are not limited to, 2000° F. to 2300° F. or 2100° F. to 2250° F. or 2100° F. to 2200° F. Suitable times for the solution heat treatment include, but are not limited to, 1 to 4 hours, 2 to 4 hours or 2 to 3 hours. In one embodiment, the solution heat treatment includes heating at a temperature about 2100° F. for a time of about 2 hours. In another embodiment, the solution heat treatment includes heating at a temperature about 2200° F. for a time of about 2.5 hours. The specific temperature and times for the solution heat treatment vary depending on the material of the substrate 101 and the material of the aluminide diffusion coating 105. The dissolution mechanism may include, but is not limited to, incipient melting of the interdiffusion zone 109 into the substrate 101.

After dissolution of at least a portion of the interdiffusion zone 109, the additive layer is selectively removed (step 305). As used herein, the term "selective removal" of the aluminide coating refers to the removal of at least a portion of the aluminum-infused additive layer 107, while removing only a very small portion or none of dissolved interdiffusion zone 201. Suitable methods for selective removal of the additive layer include, but are not limited to, grit blasting, water jet abrasive stripping, laser ablation and acid dipping. Suitable processes for grit blasting include light grit blasting using, for example, 220# grit at 40-60 PSI. Suitable methods for selective removal also include acid dips in acids, such as, HCl, a mixture of HCl and $H_3PO_4$, HCl and $H_2SO_4$, and $HNO_3$ and $H_3PO_4$. Other removal techniques includes additive coating removal (ACR) methods, as recited in U.S. Pat. No. 6,758,914, which is hereby incorporated by reference in its entirety. In one embodiment, the selective removal includes an acid dipping for short periods of time, for example, a single cycle in an acid solution of 20-40 weight percent nitric acid solution to permit the acid to react with the aluminum-infused additive layer 107. Selective removal of at least a portion of the additive layer includes a reduction in the thickness of the component of less than 0.3 mils, less than 0.2 mils or less than 0.1 mils, as measured from the position of the substrate surface 103 prior to diffusing the aluminum.

Subsequent to the selective removal, the process may further include deposition of an aluminide bond coat or aluminide diffusion coating, such as an aluminum-infused additive layer. In one embodiment, the deposition is provided prior to returning the component to service. The deposition may include the same aluminum-infused additive layer present on the component having the diffusion coating. Alternatively, the deposition may include a material different than the aluminum-infused additive layer originally formed on the component. The deposition process may include any known process for providing aluminide diffusion coatings.

Figure 5:
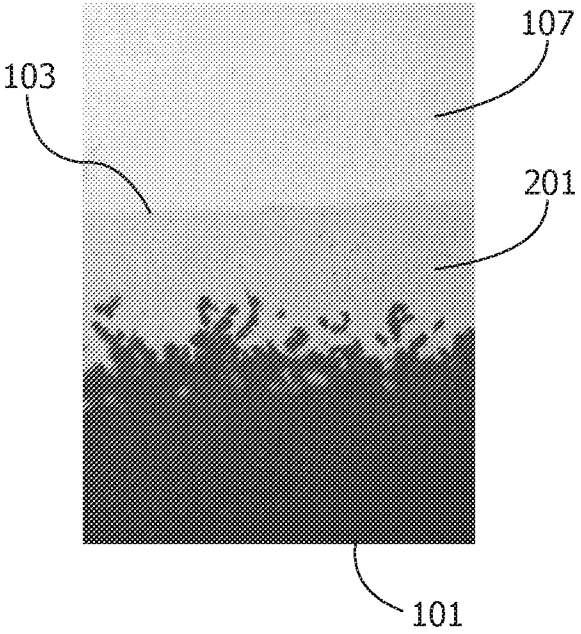
FIG. 5 shows a micrograph of the component of FIG. 4 after a solution heat treatment under vacuum.
Figure 4:
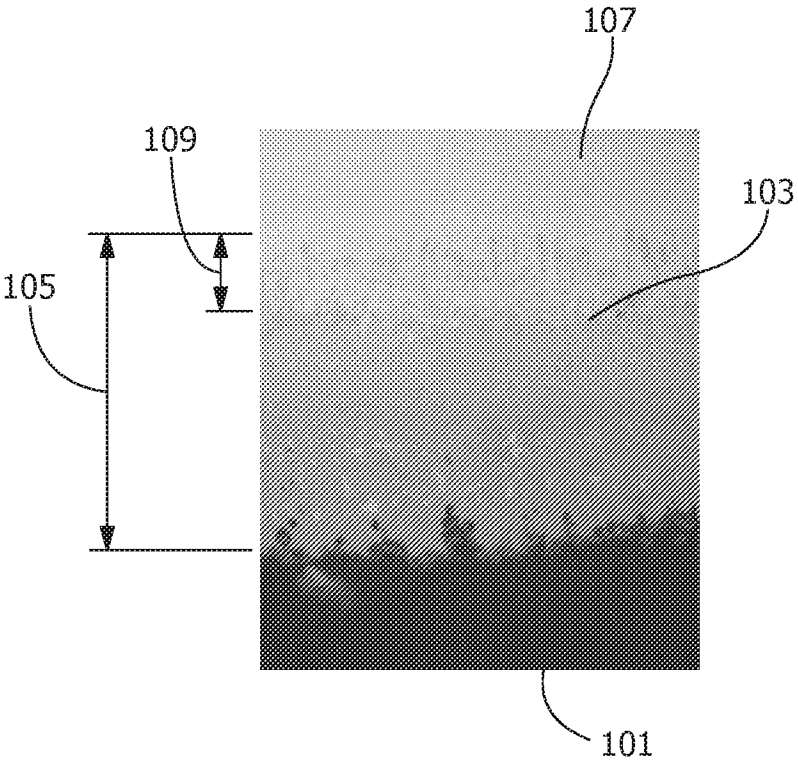
FIG. 4 shows a micrograph showing a cross section of a coating on a component having an aluminide coating prior to a solution heat treatment under vacuum.

FIG. 4 show a micrograph of a component having an aluminide-infused additive layer 107 prior to solution heat treatment. As is visible in FIG. 4, after the diffusing of the aluminum into the component, the aluminum-infused additive layer 107 and the interdiffusion zone 109 are visible on the substrate 101, as well as the substrate surface 103. FIG. 5 show a micrograph of the component from FIG. 4 after a solution heat treatment. As is visible in FIG. 5, the interdiffusion zone 109 is no longer visible due to dissolution into the substrate 101. In addition, the interface corresponding to the original substrate surface 103 is visible. Subsequent selective removal permits removal of the aluminum-infused additive layer 107 with little or no reduction or thickness.

While the invention has been described with reference to one or more embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In addition, all numerical values identified in the detailed description shall be interpreted as though the precise and approximate values are both expressly identified.

The invention claimed is:

1. A method for selective aluminide diffusion coating removal, the method comprising:

diffusing aluminum into a substrate surface of a component to form a diffusion coating, the diffusion coating comprising an aluminum-infused additive layer and an interdiffusion zone;

solution heat treating the diffusion coating under vacuum at a temperature and for a time sufficient to dissolve at least a portion of the interdiffusion zone; and thereafter selectively removing the aluminum-infused additive layer.

2. The method of claim 1, wherein the component is a component selected from the group consisting of a shroud, a turbine blade, a nozzle and a vane.

3. The method of claim 1, wherein the solution heat treatment includes heating the diffusion coating to a temperature of from 2000° F. to 2300° F.

4. The method of claim 3, wherein the solution heat treatment includes heating the diffusion coating for a time between about 1 to 4 hours.

5. The method of claim 1, wherein the selectively removing includes removing by one of the group selected from grit blasting, water jet abrasive stripping, laser ablation and acid dipping.

6. The method of claim 1, wherein the selectively removing includes grit blasting.

7. The method of claim 1, wherein the selectively removing includes acid dipping.

8. The method of claim 1, wherein the selectively removing includes a reduction in the thickness of the component of less than 0.3 mils.

9. The method of claim 1, wherein the selectively removing includes a reduction in the thickness of the component of less than 0.2 mils.

10. The method of claim 1, wherein the selectively removing includes a reduction in the thickness of the component of less than 0.1 mils.

11. A method for aluminide diffusion coating removal from a substrate of a gas turbine component, the method comprising:

removing the component from a gas turbine after operation of the gas turbine, the component having a diffusion coating, the diffusion coating comprising an aluminum-infused additive layer and an interdiffusion zone;

solution heat treating the diffusion coating under vacuum at a temperature and for a time sufficient to dissolve at least a portion of the interdiffusion zone; and thereafter selectively removing the aluminum-infused additive layer.

12. The method of claim 11, wherein the component is a component selected from the group consisting of a shroud, a turbine blade, a nozzle and a vane.

13. The method of claim 11, wherein the solution heat treatment includes heating the diffusion coating to a temperature of from 2000° F. to 2300° F.

14. The method of claim 13, wherein the solution heat treatment includes heating the diffusion coating for a time between about 1 to 4 hours.

15. The method of claim 11, wherein the selectively removing includes removing by one of the group selected from grit blasting, water jet abrasive stripping, laser ablation and acid dipping.

16. The method of claim 11, wherein the selectively removing includes grit blasting.

17. The method of claim 11, wherein the selectively removing includes acid dipping.

18. The method of claim 11, wherein the selectively removing includes a reduction in the thickness of the component of less than 0.3 mils.

19. An aluminide diffusion coated turbine component comprising:

a substrate comprising a nickel-based or cobalt-based superalloy; and an aluminide diffusion coating on a surface of the substrate, the aluminide diffusion coating having a dissolved interdiffusion zone, the dissolved interdiffusion zone being a zone in which at least a portion of a preexisting interdiffusion zone is dissolved into the substrate under vacuum, wherein an aluminum-infused additive layer has been selectively removed from the aluminum diffusion coating, and, wherein the dissolved interdiffusion zone is resistant to removal relative to an aluminum-infused additive layer of a comparative aluminide diffusion coating which is identical to the aluminide diffusion coating except that the preexisting interdiffusion zone is not dissolved into a comparative substrate and an aluminum-infused additive layer has not been selectively removed.

20. The aluminide diffusion coated turbine component of claim 19, wherein the component is a component selected from the group consisting of a shroud, a turbine blade, a nozzle and a vane.

* * * * *